US008348779B2

(12) United States Patent
Kim

(10) Patent No.: US 8,348,779 B2
(45) Date of Patent: Jan. 8, 2013

(54) TRAINING DEVICE FOR GOLF SWING

(76) Inventor: Hyen Soo Kim, Goyang-si (KR)

( * ) Notice: Subject to any disclaimer, the term of this patent is extended or adjusted under 35 U.S.C. 154(b) by 0 days.

(21) Appl. No.: 13/260,362

(22) PCT Filed: Nov. 27, 2009

(86) PCT No.: PCT/KR2009/007042

§ 371 (c)(1),
(2), (4) Date: Sep. 25, 2011

(87) PCT Pub. No.: WO2010/110525

PCT Pub. Date: Sep. 30, 2010

(65) Prior Publication Data

US 2012/0021847 A1 Jan. 26, 2012

(30) Foreign Application Priority Data

Mar. 26, 2009 (KR) ..... 10-2009-0025794

(51) Int. Cl.
*A63B 69/36* (2006.01)

(52) U.S. Cl. ..... 473/219; 473/223; 473/257

(58) Field of Classification Search ..... 473/219, 473/223, 224, 226, 257, 422, 457
See application file for complete search history.

(56) References Cited

U.S. PATENT DOCUMENTS

| | | | | |
|---|---|---|---|---|
| 4,809,975 | A * | 3/1989 | Lee | 482/110 |
| 7,297,077 | B1 * | 11/2007 | Battaglino | 473/457 |
| 7,621,859 | B2 * | 11/2009 | Kim | 482/139 |

FOREIGN PATENT DOCUMENTS

| | | |
|---|---|---|
| JP | 2002-065922 | 3/2002 |
| KR | 10-2007-0057164 | 6/2007 |
| KR | 20-0438971 | 3/2008 |
| KR | 10-2009-0014639 | 2/2009 |

OTHER PUBLICATIONS

International Search Report for PCT/KR2009/007042 Mailed on Jul. 5, 2010.

* cited by examiner

*Primary Examiner* — Nini Legesse
(74) *Attorney, Agent, or Firm* — Christopher Paul Mitchell

(57) ABSTRACT

A training device for golf swings, which overcomes the elastic resistance arising from the coil-spring on a golf swing and accelerates the head speed to strengthen and to accelerate the impact, thus magnifying the centrifugal force.

18 Claims, 8 Drawing Sheets

TRAINING DEVICE FOR GOLF SWING

RELATED APPLICATIONS

This application is a 371 application of International Application No. PCT/KR2009/007042, filed Nov. 27, 2009, which in turn claims priority from Korean Patent Application No. 10-2009-0025794, filed Mar. 26, 2009, each of which is incorporated herein by reference in its entirety.

TECHNICAL FIELD

The present invention relates to a training device for golf swing, more specifically, a training device for golf swing which can strengthen muscles for golf swing and increase a flying distance of the golf ball and power.

BACKGROUND ART

In recent, the trend in golf is that it is spread as a leisure sport and gradually popularized.

In general, the golf is a game where competing players use golf clubs to hit golf balls on a spot in a golf course into holes spaced from the spot with a fixed distance, and victory and defeat is determined by the number of hitting of the golf ball until the ball enters the hole starting from the initial hitting position. For reducing the number of hitting of the golf ball, above all, it would important that the golf ball is accurately hit by the golf clubs to obtain desired direction and flying distance.

The way of hitting the golf ball includes T-shot, fairway wood shot, iron shot, approach shot, bunker shot, putting etc., and the golf clubs to be used and posture vary depending on each way of hitting. However, in case of basic swing motions for T-shot, fairway wood shot, iron shot etc., motions of back swing, down swing, impact, follow through etc. are continuously carried out. Herein, the back swing is a motion of lifting the golf club backward, and the down swing is a motion of swing the golf club downward. Then, the impact is the moment of hitting the golf ball by the golf club, and the follow through is a motion of naturally extending the golf club forward and upward while turning the waist to the left after hitting the golf ball by a head of the golf club.

For continuously and accurately carrying out the swing motions as described above, the player should have an good command of each motion. For this purpose, many training devices are disclosed for conveniently correcting the swing motions.

According to "golf club for training of swing" disclosed in Korean U.M. No. 0410215, the swing is exercised using weights as the head of the golf club. In this case, variation of centrifugal force only depends on acceleration of swing by user because the length of the golf club is fixed in swing, and therefore variation of hitting power between the time of starting of the swing and the time of hitting is not wide. Therefore, there is a problem that training of swing can not be effectively carried out for concentratively exhibiting the hitting power at an impact position. That is, there is also a problem that desired flying distance is difficult to obtain because training of swing for stable swing and exact hitting of the ball is difficult to carry out.

DISCLOSURE OF THE INVENTION

Therefore, an object of the present invention is to provide a training device for golf swing wherein by overcoming the elastic resistance generated from the coil spring in swing and accelerating the head speed, the length of the training device for golf swing is increased, and initial position is restored by elastic force after swing, accordingly the time of maximization of the hitting power can be easily recognized visually and by feeling.

A training device for golf swing according to a first example of the present invention comprises a first body section having a rod shape; a grip section installed at one end part of the first body section; a rod section screw-joined at its one end par to the other end part of the first body section and having a larger outer diameter than that of the first body section and an inner space; a second body section wherein a part thereof is inserted into a insertion hole formed at the other end part of the rod section and a protrusion having a larger outer diameter than diameter of the insertion hole is formed at one end part of the inserted part; a head section installed at the other end part of the second body section; and an elastic member arranged around the second body section in such a way that both end parts of the member contact with the protrusion and inner surface of the other end part of the rod section and generating elastic resistance according to swing speed in swing motion such that a part of the second body section can be moved within the rod section by centrifugal force.

Furthermore, a plurality of fixing holes are formed in a row in a longitudinal direction of the second body section in the rod section, and the training device may further comprise a length-adjusting means that engages any one selected from the plurality of the fixing holes to control the position of the protrusion within the rod section, thereby adjusting a range of movement of the elastic member.

Furthermore, the elastic member is in a coil spring shape and may be formed in such a way that its pitch gradually narrows from one end part contacting with the protrusion to the other end part contacting with the inner surface of the other end part of the rod section.

Furthermore, the head section may consist of a supporting part connected with the other end part of the second body section and a weight-adjusting weight coupled with the supporting part by thread engagement.

A training device for golf swing according to a second example of the present invention comprises a head section installed at one end part of a first body section having a rod shape; a rod section integrally connected at one end part thereof with the other end part of the first body section and having a larger outer diameter than that of the first body section and an inner space; a second body section wherein a part thereof is inserted into a insertion hole formed at the other end part of the rod section and a protrusion having a larger outer diameter than diameter of the insertion hole is formed at one end part of the inserted part; a grip section installed at the other end part of the second body section; and an elastic member arranged around the second body section in such a way that both end parts of the member contact with the protrusion and inner surface of the other end part of the rod section and generating elastic resistance according to swing speed in swing motion such that a part of the second body section can be moved within the rod section by centrifugal force.

Furthermore, a plurality of recesses are formed with a fixed interval on outer surface of the part of the second body section inserted within the rod section, and outside the other end part of the rod section, a length-adjusting means may be fitted in any one selected from the plurality of the recesses to control the position of the protrusion within the rod section, thereby adjusting a range of movement of the elastic member.

Furthermore, the elastic member is in a coil spring shape and may be formed in such a way that its pitch gradually narrows from one end part contacting with the protrusion to the other end part contacting with the inner surface of the other end part of the rod section.

Furthermore, the rod section may be comprised of a case and a cap such that the elastic member can be changed.

Furthermore, the head section may consist of a supporting part connected with one end part of the first body section and a weight-adjusting weight coupled with the supporting part by thread engagement.

A training device for golf swing according to a third example of the present invention comprises a first body section having a rod shape and an insertion groove formed at one end part thereof with a fixed depth; a grip section installed at the other end part of the first body section; a second body section wherein a part thereof is inserted into the insertion groove of the first body section and a protrusion having a larger outer diameter than inner diameter of the insertion groove is formed at one end part of the inserted part; a head section installed at the other end part of the second body section; and an elastic member arranged between the first body section and the second body section such that both end parts of the member contact with the protrusion and inner surface of one end part of the first body section and generating elastic resistance according to swing speed in swing motion such that a part of the second body section can be moved within the insertion groove by centrifugal force.

Furthermore, the elastic member is in a coil spring shape and may be formed in such a way that its pitch gradually narrows from one end part contacting with the protrusion to the other end part contacting with the inner surface of one end part of the first body section.

Furthermore, the head section may consist of a supporting part connected with the other end part of the second body section and a weight-adjusting weight coupled with the supporting part by thread engagement.

Furthermore, a neck of the head section may be screw-joined to the second body section such that the head section can be changed.

As described above, according to the present invention, by overcoming the elastic resistance generated from the coil spring in swing and accelerating the head speed, the length of the training device for golf swing is increased, and initial position is restored by the elastic force after swing, accordingly the time of maximization of the hitting power can be easily recognized visually and by feeling.

Furthermore, by increasing the centrifugal force through realization of a strong and fast impact, the training for increasing a flying distance of the golf ball and power can be easily carried out and muscles for golf swing can be strengthened.

DETAILED DESCRIPTION OF THE INVENTION

Figure 1:
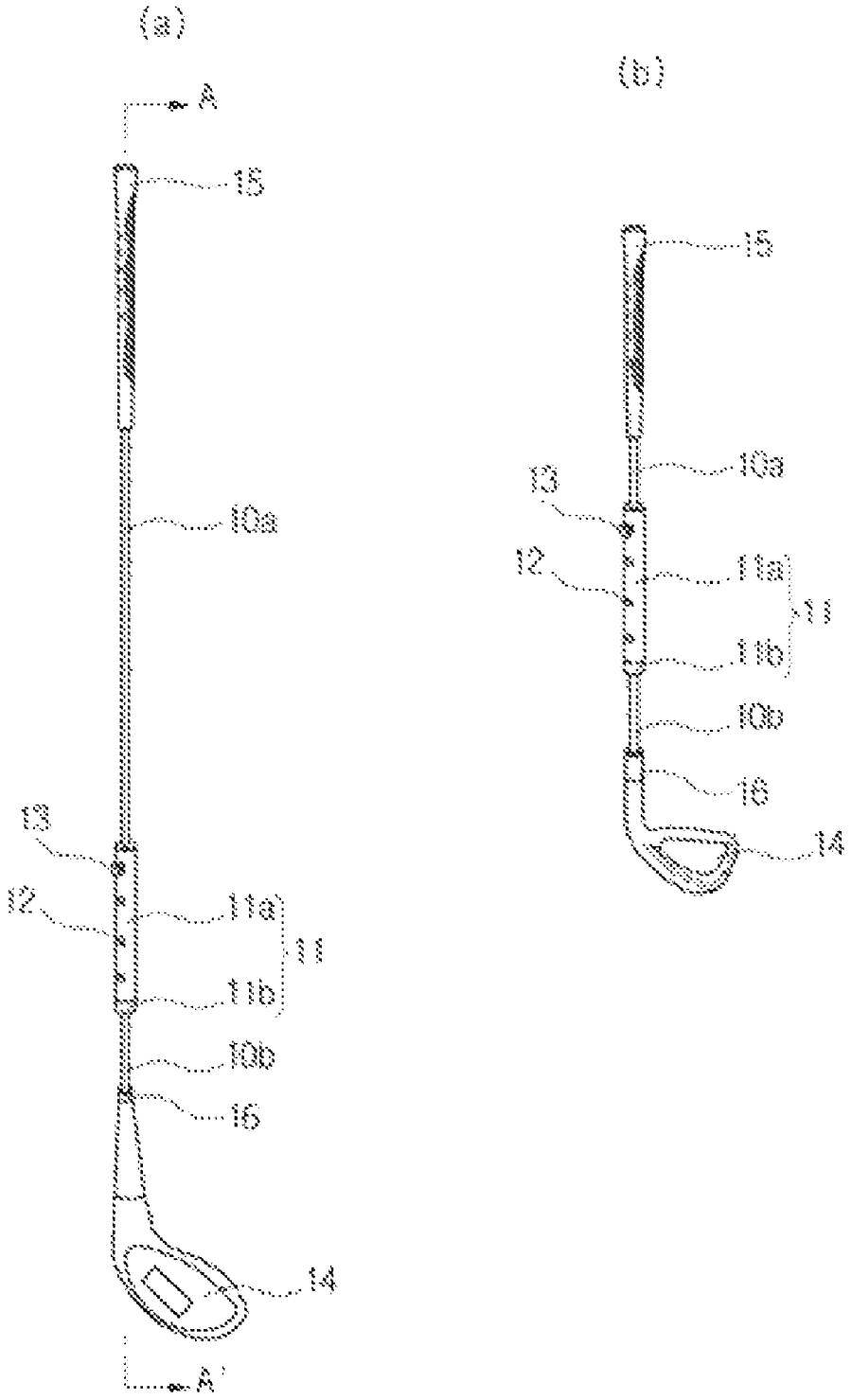
FIG. 1*a* and FIG. 1*b* are perspective views showing a training device for golf swing according to a first example of the present invention.

Hereinafter, the training device for golf swing according to the present invention will be described in detail with reference to the attached drawings illustrating examples of the present invention.

FIG. 1*a* and FIG. 1*b* are perspective views showing a training device for golf swing according to a first example of the present invention.

Referring to FIG. 1*a*, the training device for golf swing according to the first example of the present invention comprises a first body section (10*a*) having a rod shape. A grip section (15) is fitted on one end part of the first body section and one end part of a rod section (11) is screw-joined to the other end part of the first body section (10*a*). The rod section (11) has a larger outer diameter than that of the first body section (10*a*) and an inner space, and an insertion hole (19) is formed at the other end part of the rod section (refer to FIG. 2*a*).

A part of a second body section (10*b*) is inserted into the insertion hole (19) formed at the other end part of such a rod section (11), wherein formed at one end part inserted is a protrusion (17) having a larger outer diameter than the diameter of the insertion hole (19). Furthermore, a head section (14) is installed at the other end part of the second body section (10*b*). In this connection, a neck (16) of the head section (14) is screw-joined to the second body section (10*b*), whereby the head section can be replaced with drivers, irons, various weights etc. Accordingly, the user can plan strength suitable for himself or herself and phased enhancement of swing power.

Furthermore, an elastic member (18) is arranged around the second body section (10*b*) in such a way that both end parts of the member contact with the protrusion (17) and inner surface of the other end part of the rod section (11). Therefore, the elastic member (18) generates elastic resistance according to swing speed in swing motion such that a part of the second body section (10*b*) can be moved within the rod section (11) by centrifugal force. In this connection, the elastic member (18) is in a coil spring shape and formed in such a way that its pitch gradually narrows from one end part contacting with the protrusion (17) to the other end part contacting with the inner surface of the other end part of the rod section (11).

In the rod section (11) of the training device for golf swing according to such first example, a plurality of fixing holes (12) are formed in a row in a longitudinal direction of the second body section (10*b*), and a length-adjusting means (13) is provided which engages any one selected from the plurality of fixing holes (12). Preferably, the length-adjusting means (13) may be a bolt engaging the fixing holes(12). The length-adjusting means (13), which engages the holes to be inserted into the rod section (11) as described above, adjusts a range of movement of the elastic member (18) by controlling the position of the protrusion (17). Furthermore, the rod section (11) is comprised of a case (11*a*) and a cap (11*b*), which allows change of the elastic member (18), whereby the user can plan strength suitable for himself or herself and phased enhancement of swing power.

The training device for golf swing of FIG. 1*b* comprises shorter grip section (15) and shorter first body section (10*a*) than those in FIG. 1*a* such that the device may be used in a narrow space, for example indoors. Since the first body section (10*a*) is screw-joined to one end part of the rod section (11), change can be allowed to the grip section (15) and the first body section (10*a*) each having a length for use in a specific place. That is, for the training device for golf swing of FIG. 1*b*, by replacing the body section (10*a*) with shorter one, swing can be exercised in a narrow room as well as outdoors. Furthermore, the neck (16) of the head section (14) is also screw-joined to the second body section (10*b*), whereby the head section (14) can be changed to various weights, drivers, irons, putters and the like. Accordingly, the head section (14) of the training device for golf swing for use in a narrow place may be changed to iron and conveniently used.

Figure 2:
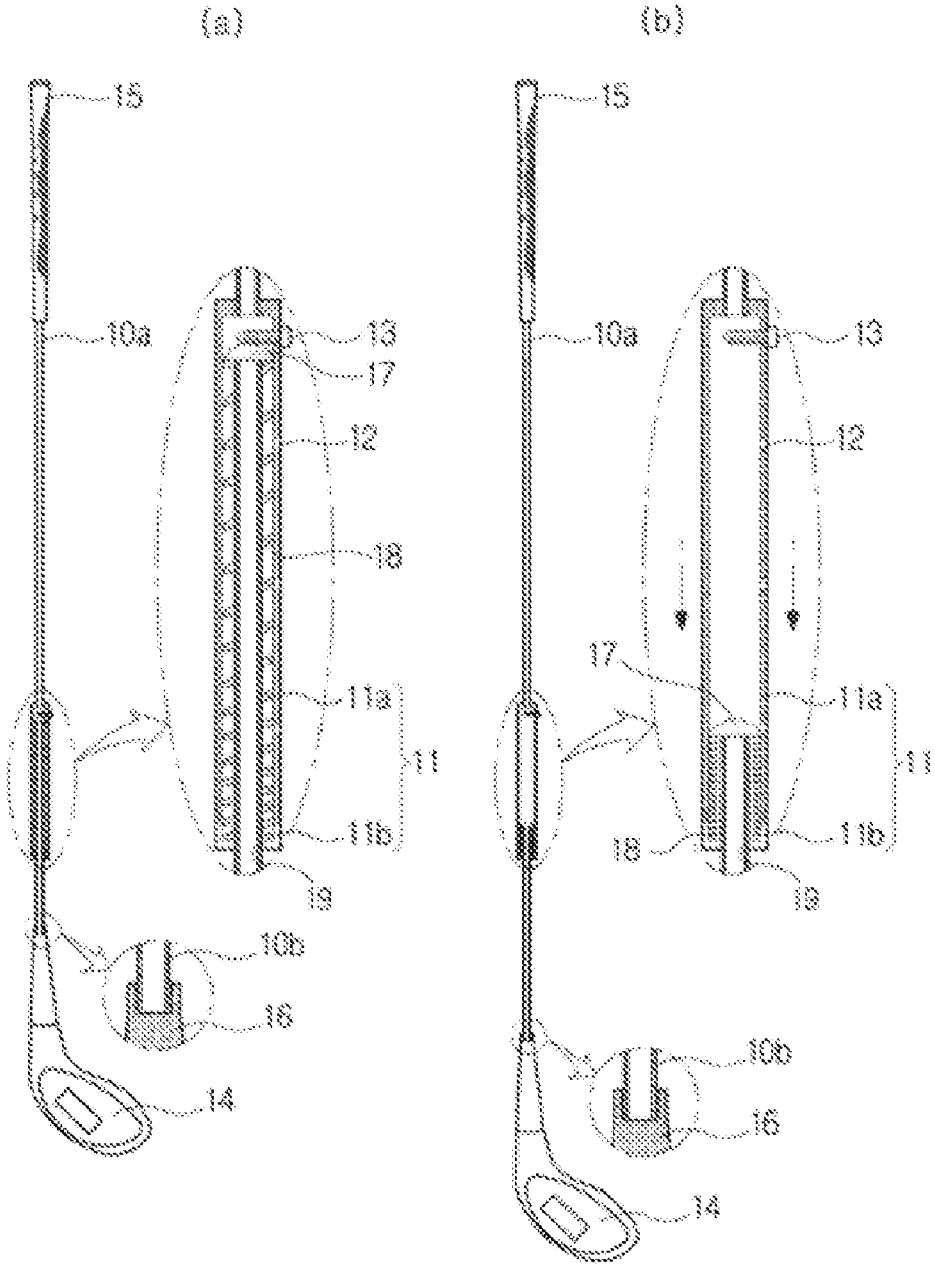
FIG. 2*a* is a sectional view taken along line A-A' of FIG. 1 before swing.
FIG. 2*b* is a sectional view taken along line A-A' of FIG. 1 after swing.

FIG. 2*a* is a sectional view taken along line A-A' of FIG. 1 before swing, and FIG. 2*b* is a sectional view taken along line A-A' of FIG. 1 after swing.

When a user takes up the swing posture holding the grip section (15) of training device for golf swing according to the first example of the present invention, the protrusion (17) at one end part of the second body section (10*b*) is in a position controlled by the length-adjusting means (13) within the rod section (11), as shown in FIG. 2*a*.

If swing is done, the elastic member (18) is pressed toward the inner surface of the other end part of the rod section (11) by the centrifugal force generated in swing as shown in FIG. 2*b*. At this time, the protrusion (17) at one end part of the second body section (10*b*) fully presses the elastic member (18) toward the other end part of the rod section (11), and the second body section (10*b*) is extended out from the rod section (11) while the protrusion (17) engages the inside of the rod section (11). That is, by overcoming the elastic resistance from the elastic member (18) and accelerating the head speed, the second body section (10*b*) is extended out from the rod section (11), and thus the length of the training device for golf swing is increased.

In this connection, the magnitude of maximum elastic resistance from the elastic member (18) may be varied by adjusting of the range of movement of the elastic member (18) by means of the length-adjusting means (13) and the fixing holes (12). That is, since the higher the swing speed is, the larger the centrifugal force is and accordingly the larger the magnitude of the elastic resistance that can be overcome is, the user can acquaint him or herself with swing feeling by properly adjusting a strength according to swing.

The elastic member (18) used in the training device for golf swing of the first example is in a coil spring shape and formed in such a way that its pitch gradually narrows from one end part contacting with the protrusion (17) to the other end part contacting with the inner surface of the other end part of the rod section (11). Accordingly, the elastic resistance can be adjusted stepwise according to the high or low swing speed, and the highest swing speed can be obtained at the moment of impact. Muscles for golf swing can be strengthened by increasing the centrifugal force while making the impact strong and fast by accelerating the head speed through overcoming of the elastic resistance produced from the coil spring in swing. In addition, the training for increasing a flying distance of the golf ball and power can be easily carried out.

If the centrifugal force is decreased after swing, the second body section (10*b*) is returned to its initial position by the elastic force of the elastic member (18). Accordingly, the time of maximization of the hitting power can be easily recognized visually through the change of the length of the training device for golf swing.

When swing is done using the training device for golf swing according to the first example of the present invention as described above, the centrifugal force can be maximally exhibited at the time of rotation of the head section (14) by swing in a stable and natural posture with the shoulders and arms of the user being relaxed. Furthermore, a training can be easily carried out repeatedly for producing centripetal force corresponding to the centrifugal force produced at the time of rotation of head section (14) through the body of the user. That is, more stable and exact swing motion is made possible such that the centrifugal force according to rotation of the training device for golf swing and the centripetal force corresponding to the centrifugal force are balanced.

Figure 3:
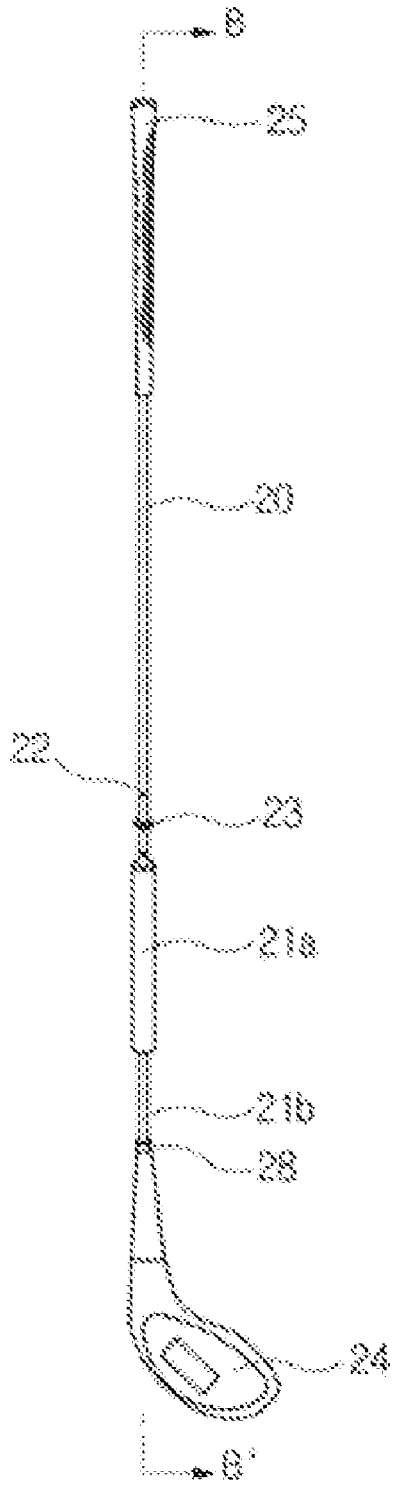
FIG. 3 is a perspective view showing a training device for golf swing according to a second example of the present invention.

FIG. 3 is a perspective view showing a training device for golf swing according to a second example of the present invention.

Referring to FIG. 3, in the training device for golf swing according to the second example of the present invention, a head section (24) is installed at one end part of a first body section (21*b*) of a rod shape, and a neck (28) of the head section (24) is screw-joined to the first body section (21*b*) such that the head section can be changed. Furthermore, the other end part of the first body section (21*b*) is integrally connected with one end part of a rod section (21*a*) having an inner space and a larger outer diameter than that of the first body section (21*b*). An insertion hole (29) is formed at the other end part of the rod section (21*a*), and inserted into this insertion hole (29) is a part of a second body section (20), and one end part of the second body section inserted is formed with a protrusion (26) having a larger outer diameter than the diameter of the insertion hole (29). Furthermore, a grip section (25) is fitted at the other end part of the second body section (20).

Furthermore, an elastic member (27, refer to FIG. 4*a*) is arranged around the second body section (20) in such a way that both end parts of the member contact with the protrusion (26, refer to FIG. 4*a*) and inner surface of the other end part of the rod section (21*a*). The elastic member generates the elastic resistance according to swing speed in swing motion such that a part of the second body section (20) can be moved within the rod section (21*a*) by the centrifugal force. In this connection, the elastic member (27) is in a coil spring shape and formed in such a way that its pitch gradually narrows from one end part contacting with the protrusion (26) to the other end part contacting with the inner surface of the other end part of the rod section (21*a*).

A plurality of recesses (22) are formed with a fixed interval on outer surface of the part of the second body section (20) inserted within the rod section (21*a*) of the training device for golf swing according to the second example. Outside the other end part of the rod section (21*a*), a length-adjusting means (23) is fitted in any one selected from the plurality of the recesses (22), thereby controlling position of the protrusion (26) within the rod section (21*a*) to adjust the range of movement of the elastic member (27).

Figure 4:
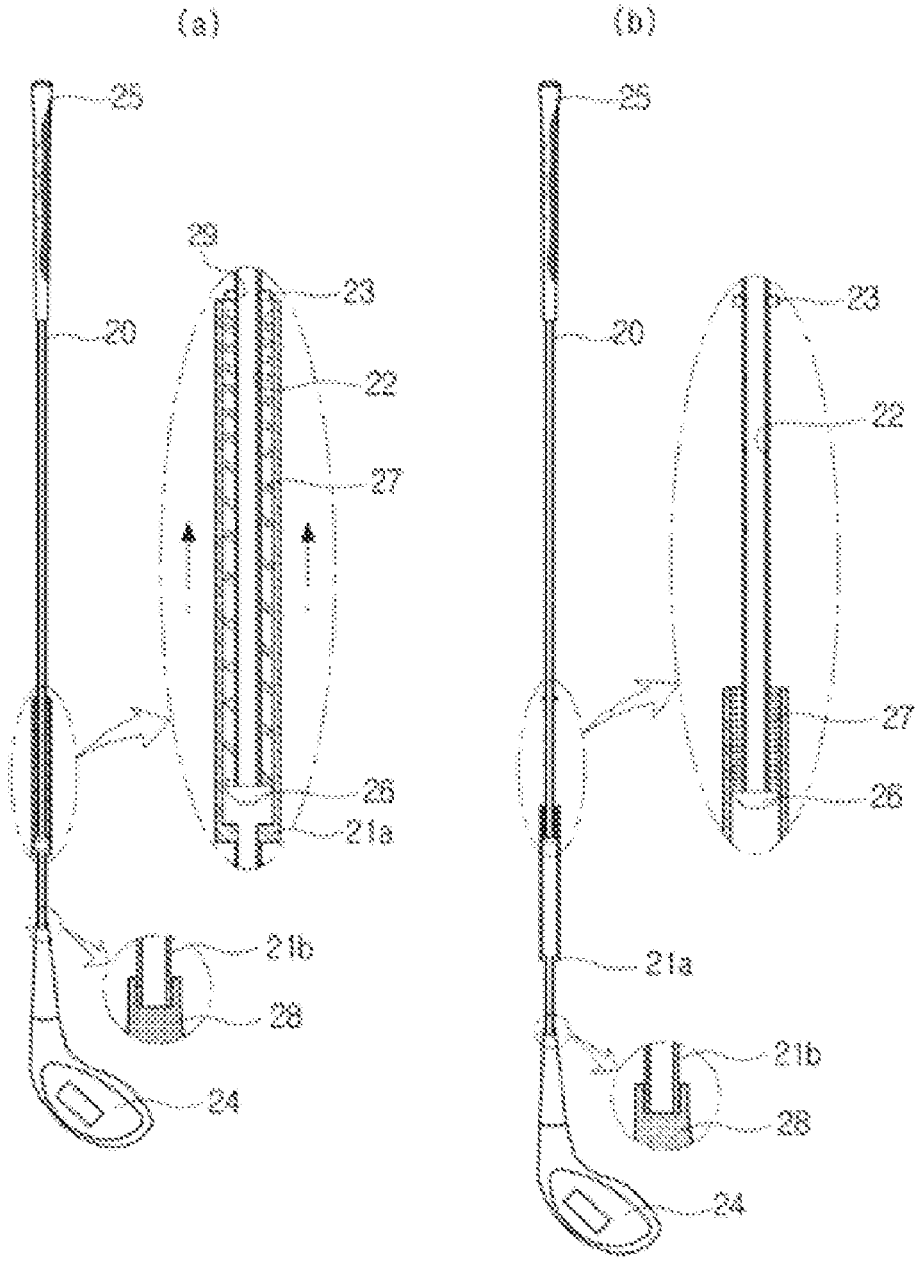
FIG. 4*a* is a sectional view taken along line B-B' of FIG. 4 before swing.
FIG. 4*b* is a sectional view taken along line B-B' of FIG. 4 after swing.

FIG. 4*a* is a sectional view taken along line B-B' of FIG. 3 before swing, and FIG. 4*b* is a sectional view taken along line B-B' of FIG. 3 after swing.

Referring to FIG. 4*a* and FIG. 4*b*, when the user takes up the swing posture holding the grip section (25) of the training device for golf swing according to the second example of the present invention, the protrusion (26) at one end part of the second body section (20) is in the position controlled by the recess (22) and the length-adjusting means (23) within the rod section (21*a*), as shown in FIG. 4*a*.

At this time, if swing is done, the elastic member (27) is pressed toward the inner surface of the other end part of the rod section (21*a*) by the centrifugal force generated in swing, as shown in FIG. 4*b*. At this time, the protrusion (26) at one end part of the second body section (20) fully presses the elastic member (27) toward the other end part of the rod section (21*a*), and the second body section (20) is extended out from the rod section (21*a*) while the protrusion (26) engages the inside of the rod section (21*a*). That is, by overcoming the elastic resistance from the elastic member (27) and accelerating the head speed, the second body section (20) is extended out from the rod section (21*a*), and thus the length of the training device for golf swing is increased.

In this connection, the magnitude of maximum elastic resistance from the elastic member (27) may be varied by adjusting of the range of movement of the elastic member (27) by fitting of the length-adjusting means (23) in the recesses (22) formed on the outer surface of the second body section (20). That is, since the higher the swing speed is, the larger the centrifugal force is and accordingly the larger the magnitude of the elastic resistance that can be overcome is, the user can acquaint him or herself with swing feeling by properly adjusting the strength according to swing.

If the centrifugal force is decreased after swing, the second body section (20) is returned to its initial position by the elastic force of the elastic member (27). Accordingly, the time of maximization of the hitting power can be easily recognized visually through the change of the length of the training device for golf swing.

The elastic member (27) used in the training device for golf swing of the second example is in a coil spring shape and formed in such a way that its pitch gradually narrows from one end part contacting with the protrusion (26) to the other end part contacting with the inner surface of the other end part of the rod section (21*a*), as in the first example. Accordingly, elastic resistance can be adjusted stepwise according to the high or low swing speed, and the highest swing speed can be obtained at the moment of impact.

Figure 5:
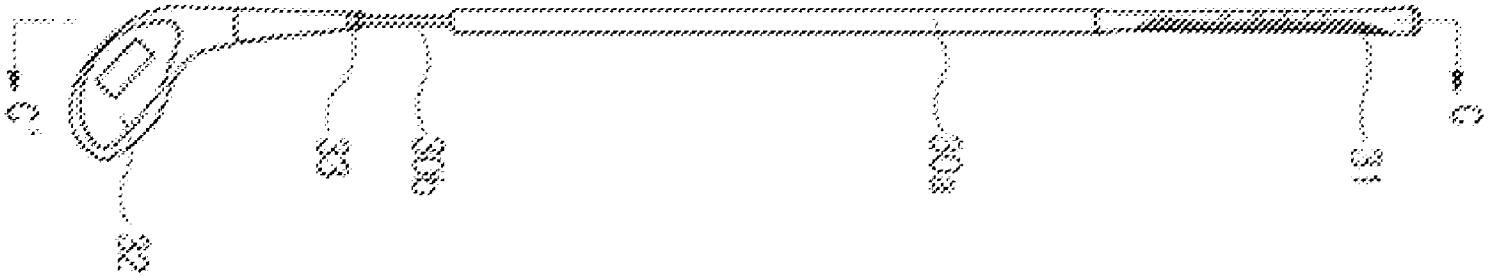
FIG. 5 is a perspective view showing a training device for golf swing according to a third example of the present invention.

FIG. 5 is a perspective view showing a training device for golf swing according to a third example of the present invention.

Referring to FIG. 5, in the training device for golf swing according to the third example of the present invention, an insertion groove (35, refer to FIG. 6*a*) is formed at one end part of a first body section (30*a*) of a rod shape, and a grip section (31) is fitted at the other end part of the first body section (30*a*). Furthermore, a part of a second body section (30*b*) is inserted into the insertion groove (35) of the first body section (30*a*), wherein formed at one end part of the second body section (30*b*) inserted is a protrusion (34) having a larger outer diameter than the inner diameter of the insertion groove (35), and a head section (32) is installed at the other end part of the second body section (30*b*). A neck (33) of the head section (32) is screw-joined to the second body section (30*b*) such that the head section can be changed.

Furthermore, an elastic member (36, refer to FIG. 6*a*) is arranged between the first body section (30*a*) and the second body section (30*b*) such that one end part of the member contacts with the protrusion (34) and the other end part is secured on inner surface of one end part of the first body section (30*a*). Such an elastic member (36) generates elastic resistance according to swing speed in swing motion such that a part of the second body section (30*b*) can be moved within the insertion groove (35) by the centrifugal force. In this connection, the elastic member (36) is in a coil spring shape and formed in such a way that its pitch gradually narrows from one end part contacting with the protrusion (34) to the other end part contacting with the inner surface of one end part of the first body section (30*a*). Accordingly, the elastic resistance can be adjusted stepwise according to the high or low swing speed.

Figure 6:
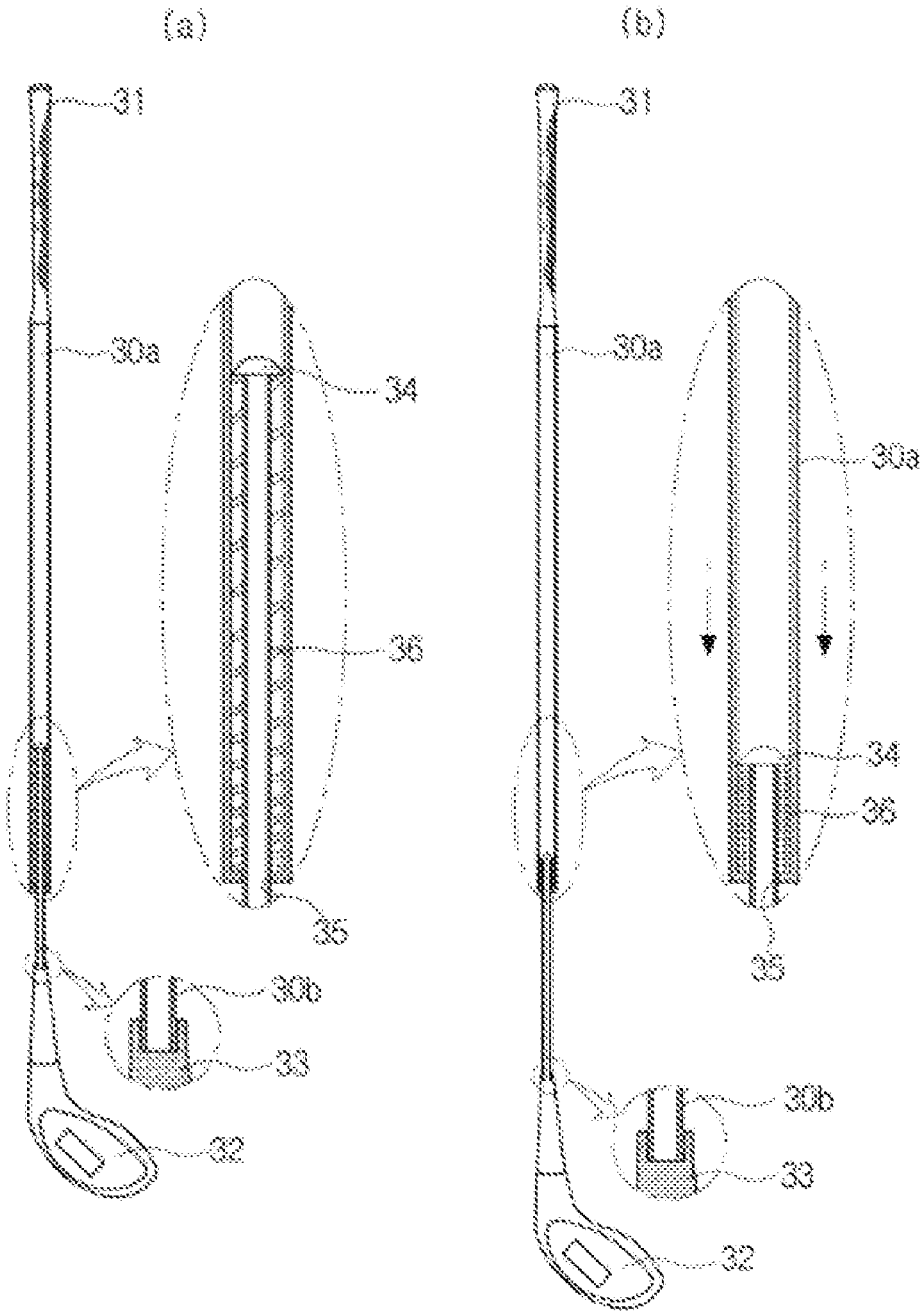
FIG. 6*a* is a sectional view taken along line C-C' of FIG. 6 before swing.
FIG. 6*b* is a sectional view taken along line C-C' of FIG. 6 after swing.

FIG. 6*a* is a sectional view taken along line C-C' of FIG. 6 before swing, and FIG. 6*b* is a sectional view taken along line C-C' of FIG. 6 after swing.

Referring to FIG. 6*a* and FIG. 6*b*, when the user takes up the swing posture holding the grip section (31) of training device for golf swing according to the third example of the present invention, the protrusion (34) at one end part of the second body section (30*b*) and a part of the second body section (30*b*) are inserted within the insertion groove (35), as shown in FIG. 6*a*.

At this time, if swing is done, the elastic member (36) is pressed while the protrusion (34) is moving toward the inner surface of one end part of the first body section (30*a*) by the centrifugal force generated in swing, as shown in FIG. 6*b*. Accordingly, the second body section (30*b*) is pushed out through the insertion groove (35) toward the side of the head section (32) by the generated centrifugal force. Therefore, if the training device for golf swing according to the third example of the present invention is used, the head speed can be accelerated through overcoming of the elastic resistance produced from the coil spring in golf swing. Accordingly, by increasing the centrifugal force while making the impact strong and fast, muscles for golf swing can be strengthened and the training for increasing a flying distance of the golf ball and power can be easily carried out.

Figure 7:
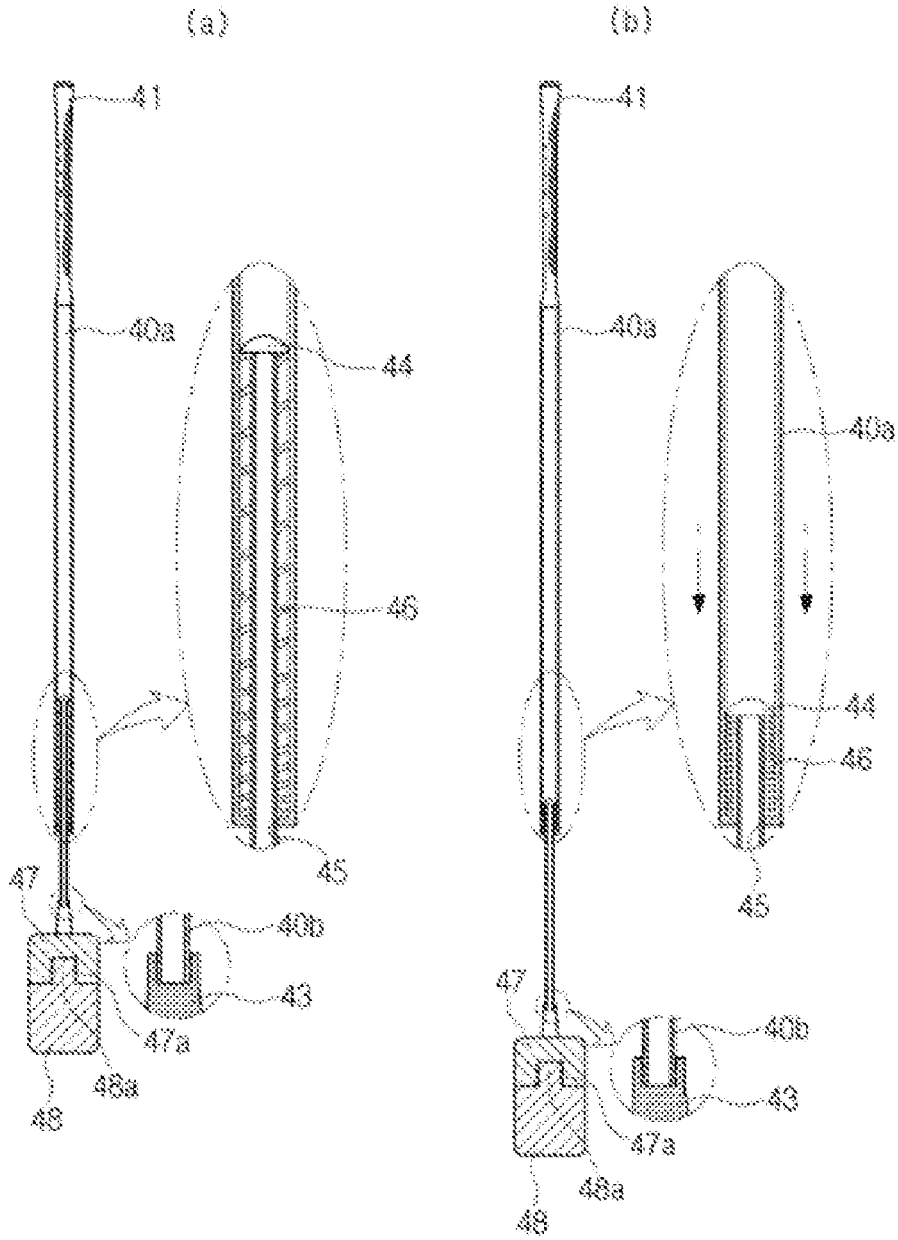
FIG. 7*a* is a sectional view before swing of a training device for golf swing according to a fourth example of the present invention.
FIG. 7*b* is a sectional view after swing of the training device for golf swing according to the fourth example of the present invention.

FIG. 7*a* is a sectional view before swing of the training device for golf swing according to a fourth example of the present invention, and FIG. 7*b* is a sectional view after swing of the training device for golf swing according to the fourth example of the present invention.

Referring to FIG. 7*a* and FIG. 7*b*, since a grip section (41), a first body section (40*a*) and a second body section (40*b*) illustrated are the same as those of the third example of the present invention, description of detailed construction and operations thereof will be omitted. Of course, the grip section (41), the first body section (40*a*) and the second body section (40*b*) illustrated may be formed according to the first and second examples.

In the fourth example of the present invention, the head section consists of a supporting part (47) connected with the other end part of the second body section (40*b*) and a weight-adjusting weight (48) coupled with the supporting part (47). In this connection, formed in a central part of lower surface of the supporting part (47) is a groove (47*a*) into which a protrusion (48*a*) of the weight-adjusting weight (48) can be inserted. The protrusion (48*a*) of the weight-adjusting weight (48) is in a bolt shape and is formed with threads on its outer surface, and inner surface of the groove (47*a*) of the supporting part (47) is formed in a nut shape so as to engage the threads of the protrusion (48*a*). In this connection, the supporting part (47) and the weight-adjusting weight (48) may be coupled with each other in another various ways other than thread engagement. Furthermore, it goes without saying that the protrusion (48*a*) may be formed in a nut shape and the supporting part (47*a*) may be formed in a bolt shape.

As described above, the weight-adjusting weight (48) coupled with the supporting part (47) can be easily assembled and disassembled, whereby the weight-adjusting weight (48) can be changed to one having a weight suitable for the user in use of the training device for golf swing.

Figure 8:
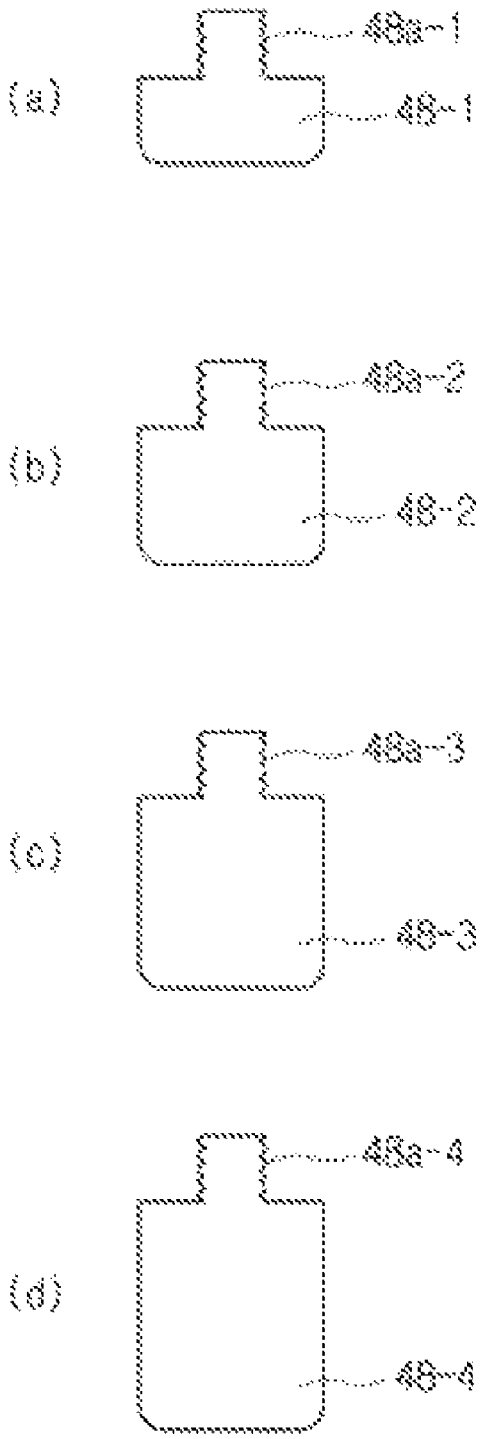
FIG. 8 is a sectional view showing the weight-adjusting weight according to the fourth example of the present invention.

FIG. 8 is a sectional view showing the weight-adjusting weight according to the fourth example.

Referring to FIG. 8, the weight-adjusting weights (48-1, 48-2, 48-3, 48-4) are provided in various sizes, and its weight varies depending on its size, wherein the larger the size of the weight-adjusting weight (48-1, 48-2, 48-3, 48-4) is, the heavier the weight is. That is, if the weight-adjusting weight of the smallest size is "48-1" and the weight-adjusting weight of the largest size is "48-4", and the weight-adjusting weights having a size between the smallest and largest sizes are "48-2" and "48-3" in the order of size, the order of weight is "48-1"<"48-2"<"48-3"<"48-4". In this connection, the sizes of the protrusions (48*a*-1, 48*a*-2, 48*a*-3, 48*a*-4) coupled with the groove (47*a*, refer to FIG. 7) of the supporting part (47, refer to FIG. 7) are all the same.

Furthermore, although the weight-adjusting weight (48-1, 48-2, 48-3, 48-4) may be heavier as its size increases, if the material for each weight-adjusting weight (48-1, 48-2, 48-3, 48-4) is different from each other, its specific weight is also different from each other, so the weight-adjusting weight (48-1, 48-2, 48-3, 48-4) may be made using different material.

Although the technical concepts of the present invention have been concretely described according to the preferred examples as described above, it should be understood that the examples are given only for the purpose of illustration of the technical concepts, not limitation thereof. Furthermore, persons having ordinary skills in the art will understand that various modified examples can be made without departing from the technical concepts of the present invention.

What is claimed is:

1. A training device for golf swing comprising:

a first body section having a rod shape;

a grip section installed at one end part of the first body section;

a rod section screw-joined at its one end part to the other end part of the first body section and having a larger outer diameter than that of the first body section and an inner space;

a second body section wherein a part thereof is inserted into an insertion hole formed at the other end part of the rod section and a protrusion having a larger outer diameter than diameter of the insertion hole is formed at one end part of the inserted part;

a head section installed at the other end part of the second body section; and an elastic member arranged around the second body section in such a way that both end parts of the member contact with the protrusion and inner surface of the other end part of the rod section and generating elastic resistance according to swing speed in swing motion such that a part of the second body section can be moved within the rod section by centrifugal force.

2. The training device for golf swing according to claim 1, wherein a plurality of fixing holes are formed in a row in a longitudinal direction of the second body section in the rod section, and the training device further comprises a length-adjusting means that engages any one selected from the plurality of the fixing holes to control the position of the protrusion within the rod section, thereby adjusting a range of movement of the elastic member.

3. The training device for golf swing according to claim 1, wherein the rod section is comprised of a case and a cap such that the elastic member can be changed.

4. The training device for golf swing according to claim 1, wherein the elastic member is in a coil spring shape and formed in such a way that its pitch gradually narrows from one end part contacting with the protrusion to the other end part contacting with the inner surface of the other end part of the rod section.

5. The training device for golf swing according to claim 1, wherein the head section consists of a supporting part connected with the other end part of the second body section and a weight-adjusting weight coupled with the supporting part.

6. The training device for golf swing according to claim 5, wherein the supporting part and the weight-adjusting weight are coupled with each other by thread engagement.

7. The training device for golf swing according to claim 1, wherein the head section consists of a supporting part connected with one end part of the first body section and a weight-adjusting weight coupled with the supporting part.

8. The training device for golf swing according to claim 7, wherein the supporting part and the weight-adjusting weight are coupled with each other by thread engagement.

9. The training device for golf swing according to claim 1, wherein the head section consists of a supporting part connected with the other end part of the second body section and a weight-adjusting weight coupled with the supporting part.

10. The training device for golf swing according to claim 9, wherein the supporting part and the weight-adjusting weight are coupled with each other by thread engagement.

11. The training device for golf swing according to claim 1, wherein a neck of the head section is screw-joined to the second body section such that the head section can be changed.

12. A training device for golf swing comprising:

a head section installed at one end part of a first body section having a rod shape;

a rod section integrally connected at one end part thereof with the other end part of the first body section and having a larger outer diameter than that of the first body section and an inner space;

a second body section wherein a part thereof is inserted into an insertion hole formed at the other end part of the rod section and a protrusion having a larger outer diameter than diameter of the insertion hole is formed at one end part of the inserted part;

a grip section installed at the other end part of the second body section; and an elastic member arranged around the second body section in such a way that both end parts of the member contact with the protrusion and inner surface of the other end part of the rod section and generating elastic resistance according to swing speed in swing motion such that a part of the second body section can be moved within the rod section by centrifugal force.

13. The training device for golf swing according to claim 12, wherein a plurality of recesses are formed with a fixed interval on outer surface of the part of the second body section inserted within the rod section, and outside the other end part of the rod section, a length-adjusting means is fitted in any one selected from the plurality of the recesses to control the position of the protrusion within the rod section, thereby adjusting a range of movement of the elastic member.

14. The training device for golf swing according to claim 12, wherein the elastic member is in a coil spring shape and formed in such a way that its pitch gradually narrows from one end part contacting with the protrusion to the other end part contacting with the inner surface of the other end part of the rod section.

15. The training device for golf swing according to claim 12, wherein a neck of the head section is screw-joined to the second body section such that the head section can be changed.

16. A training device for golf swing comprising:

a first body section having a rod shape and an insertion groove formed at one end part thereof with a fixed depth;

a grip section installed at the other end part of the first body section;

a second body section wherein a part thereof is inserted into the insertion groove of the first body section and a protrusion having a larger outer diameter than inner diameter of the insertion groove is formed at one end part of the inserted part;

a head section installed at the other end part of the second body section; and an elastic member arranged between the first body section and the second body section such that one end part of the member contacts with the protrusion and the other end part is secured on inner surface of one end part of the first body section and generating elastic resistance according to swing speed in swing motion such that a part of the second body section can be moved within the insertion groove by centrifugal force.

17. The training device for golf swing according to claim 16, wherein the elastic member is in a coil spring shape and formed in such a way that its pitch gradually narrows from one end part contacting with the protrusion to the other end part contacting with the inner surface of one end part of the first body section.

18. The training device for golf swing according to claim 16, wherein a neck of the head section is screw-joined to the second body section such that the head section can be changed.

* * * * *